United States Patent [19]

Muller et al.

[11] Patent Number: 4,641,629

[45] Date of Patent: Feb. 10, 1987

[54] APPARATUS FOR COOKING AND/OR FOR HEATING OF AIR

[75] Inventors: Fernand Muller, Ingeldorf; Nils A. Wannborg, Echternach, both of Luxembourg; Kurt Billen, Roth, Fed. Rep. of Germany

[73] Assignee: Electrolux S.a.r.l., Vianden, Luxembourg

[21] Appl. No.: 838,736

[22] Filed: Mar. 11, 1986

[30] Foreign Application Priority Data

Mar. 13, 1985 [DE] Fed. Rep. of Germany ... 8507365[U]

[51] Int. Cl.[4] ..... F24C 1/14

[52] U.S. Cl. ..... 126/6; 126/4

[58] Field of Search ..... 126/4, 6, 37 R, 37 A, 126/37 B, 39 R, 39 A, 39 C, 216, 217, 218, 248, 110 R, 110 D

[56] References Cited

U.S. PATENT DOCUMENTS

| | | | |
|---|---|---|---|
| 1,068,637 | 7/1913 | Fastiggi | 126/6 |
| 1,468,300 | 9/1923 | Hopkins | 126/6 |
| 2,088,280 | 7/1937 | Schillinger | 126/6 X |
| 2,553,278 | 5/1951 | Rogant | 126/6 |
| 3,358,670 | 12/1967 | Osborne | 126/6 X |
| 4,425,901 | 1/1984 | Callison | 126/6 |

FOREIGN PATENT DOCUMENTS

| | | | |
|---|---|---|---|
| 637397 | 10/1936 | Fed. Rep. of Germany | 126/4 |

*Primary Examiner*—Margaret A. Focarino

*Attorney, Agent, or Firm*—Kline, Rommel & Colbert

[57] ABSTRACT

Apparatus for cooking and/or heating of air, comprising a hearth having at least one hearth plate and a hinged cover which is arranged at the hearth for overlapping the hearth plate, the cover defining a chamber, a partition being provided between the upper wall and the lower wall of the cover for dividing the chamber into a first section and a second section, a passageway being provided for interconnection of said first section with said second section, an inlet being provided in communication with the upper section and an outlet being provided in communication with the lower section of the chamber, and in which the lower wall of the cover may be brought into heat conducting contact with at least one hearth plate.

2 Claims, 6 Drawing Figures

APPARATUS FOR COOKING AND/OR FOR HEATING OF AIR

BACKGROUND OF THE INVENTION

The invention relates to an apparatus for cooking and/or for heating of air, comprising a hearth having at least one hearth plate and a hinged cover which is arranged at the hearth and overlaps the hearth plate, at least a part of said cover together with the hearth plate defining a channel, through which air may be conducted by means of a fan.

Such an apparatus is suitable for being used in a caravan alternatively either as oven or for heating a room, and this is performed by a fan heating recirculated air from the hearth and blowing it into the surrounding room (U.S. Pat. No. 4,375,802).

In the known apparatus the cover consists of a one-sheet metal which forms a channel which is open toward the hearth, and in this channel the air from the hearth is heated by direct contact with the hearth plates.

The drawback of the known apparatus resides in that it is difficult to collect the heated air and to conduct it in a pipe into a space which is at some distance from the hearth, because the air may flow out without hindrance at the edges of the cover.

SUMMARY OF THE INVENTION

It is therefore the object of the invention to improve an apparatus of the above kind in a way that the heating capacity of the hearth for heating a remote space is improved.

According to the present invention the channel is enclosed in the cover and comprises an inlet, a chamber which is defined by an upper and a lower wall of the cover, and an outlet, and the lower wall of the cover may be brought in heat-conducting contact with at least one hearth plate. The inlet, the chamber, and the outlet are arranged in a manner that the fan blows the air successively through the inlet, the chamber, and the outlet. Owing to the fact that the channel is enclosed in the cover, a leakage of air may occur only at the inlet or at the outlet, but such leakage may easily be avoided by means of simple sealing means.

According to another advantageous feature of the present invention there is provided a partition between the upper wall and the lower wall of the cover, which partition divides the chamber into a first section and a second section, said sections being connected by means of a passage in a manner that the air may be conducted by means of the fan through the inlet, the first section, the passage, the second section and the outlet. The partition is suitably arranged parallel to the upper cover wall and to the lower cover wall, while the inlet and the outlet are disposed at one side of the hearth. The passage is provided at the side of the cover which is opposite to the inlet and the outlet, so that the air, which is still cold, first travels through the cover section which is defined by the partition and the upper side of the cover, then passes through the passage into the section defined by the partition and the lower side of the cover, and finally, due to the countercurrent principle, flows to the outlet in direct contact with the heated lower side of the cover. This means that the upper side of the cover, which on its outside serves as rest place, is being cooled.

Further features, advantages and details of the invention will be seen from the following description of two preferred embodiments, by reference to the accompanying drawing.

BRIEF DESCRIPTION OF THE DRAWING

List of Different Views of the drawing.

DETAILED DESCRIPTION OF THE PREFERRED EMBODIMENTS

Figure 2:
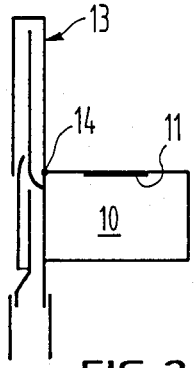
FIG. 2 is a sectional view along the line II—II according to FIG. 1.

The FIGS. 1 to 4 show a hearth 10 having a hearth plate with two hotplates 11, 12. Said hearth may be heated using e.g. gas, petroleum, Diesel fuel or electric current. At the hearth there is arranged a cover 13 which is swingable around an axis 14. The cover 13 may be swung down into a horizontal position to cover the hot-plates 11 and 12 (see FIGS. 3 and 4), or it may be swung up into a vertical position (see FIGS. 1 and 2). When the cover is swung up, the hotplates 11 and 12 may be used for cooking.

When the cover 13 is swung down, it may serve for heating the air by using the plates 11 and 12. Between an upper wall 15 and a lower, heat-conducting wall 16 of the cover 13 there is formed a closed space which is subdivided by a heat-conducting partition 17 so as to define a first section 18 and a second section 19. The sections 18 and 19 are connected by a passage 20 which is arranged between the front edge 21 of the partition 17 and a front wall section 22 of the cover 13.

Figure 1:
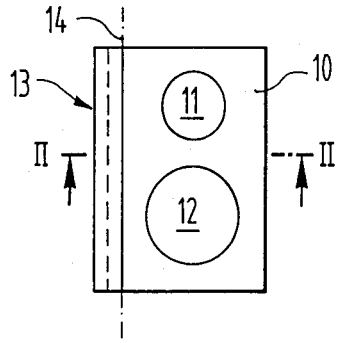
FIG. 1 is a plan view to a first embodiment of the hearth according to the invention including two hotplates and a swung-up cover.
Figure 3:
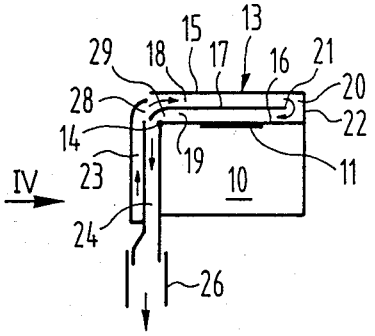
FIG. 3 shows the apparatus according to FIG. 2 with the cover being swung-down.
Figure 4:
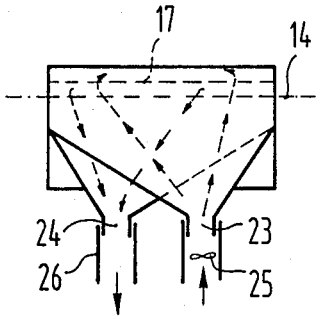
FIG. 4 shows a view of the apparatus of the invention in the direction of the arrow IV according to FIG. 3.

In the embodiment shown in the FIGS. 1 and 2 an inlet channel 23 and an outlet channel 24 are disposed at the back side of the hearth. The inlet channel 23 for the sucked-in cold air is in communication with the first section 18 of the closed space or of the chamber, and the outlet channel 24 for the heated air is in communication with the second section 19 of the space or of the chamber. FIG. 3 further shows that the cold air travels through the upper section 18, thus cooling the upper side of the cover 13, while according to the countercurrent principle it travels through the lower section 19 of the chamber to the outlet channel 24, thus being heated by passing over the hot-plates 11, 12. Owing to the fan 25 the air thus passes successively through the channel 23, the upper section 18, the passage 20, the lower section 19, the channel 24 and a pipe 26 to the room which is to be heated (not shown).

Figure 5:
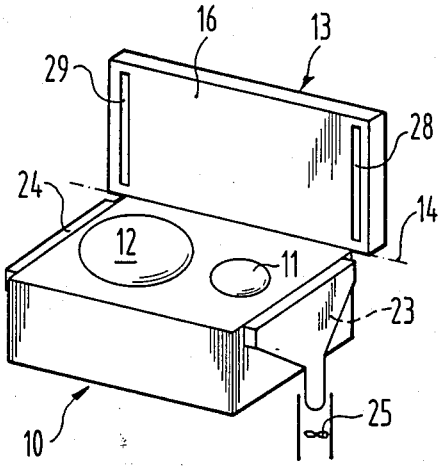
FIG. 5 shows a perspective view of another embodiment of a hearth according to the invention with the cover being swung-up.
Figure 6:
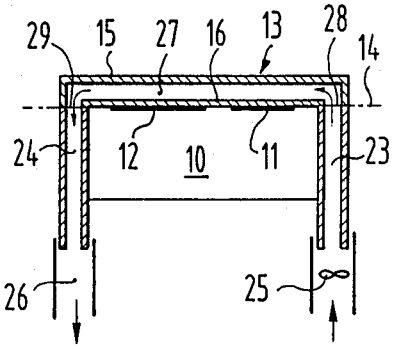
FIG. 6 shows a longitudinal cross section through the apparatus according to FIG. 5, the cover being swung-down.

In the embodiment shown in the FIGS. 5 and 6 the inlet channel 23 with the fan 25 is arranged at one side of the hearth 10, and the outlet channel 24 is arranged at the other side of said hearth. The cover 13 includes a chamber 27 which is in communication with the environment by means of two openings 28, 29. When the cover 13 is swung down to cover the hotplates 11 and 12, then the opening 28 will be in communication with the channel 23, and the opening 29 with the channel 24. When the fan 25 is started, air is blown through the chamber 27 and heated by the hotplates 11 and 12 through a wall 16 of the cover 13. The pipe 26 conducts the heated air to the room to be heated.

Instead of the hotplates 11 and 12 there may also be provided a hearth plate in form of glass ceramics, by which the air traveling through the cover 13 may be heated.

We claim:

1. Apparatus for cooking and/or heating of air, comprising a hearth having at least one hearth plate and a hinged cover which is arranged at the hearth and overlaps the hearth plate, said cover including a channel through which air may be conducted by means of a fan, said channel being enclosed in said cover and comprising an inlet, a chamber, and an outlet, said chamber being defined by an upper wall and a lower wall of said cover, a partition being provided between said upper wall and said lower wall for dividing said chamber into a first section and a second section, said first section and said second section being connected by means of a passage in a manner so that air may be conducted by means of a fan through said inlet, thence through said first section, thence through said passage, thence through said second section, and thence through said outlet, said inlet and said outlet being arranged at one common side of said hearth, said partition being arranged parallel to said upper wall and said lower wall of said chamber in a manner so that said inlet is in communication with said first section of said chamber and said outlet is in communication with said second section of said chamber, said passage being provided at the side of said cover which is opposite to said inlet and said outlet, and in which said lower wall of said cover may be brought into heat conducting contact with at least one hearth plate in juxtarelationship whereby air conducted through said cover is heated as it flows through said second section of said chamber of said cover and the upper side of said cover is cooled by air flowing through said first section of said chamber of said cover.

2. Apparatus for cooking and/or heating of air, comprising a hearth having at least one hearth plate means, a cover, said cover including a chamber, said chamber being defined by an upper wall and a lower wall of said cover, a partition being provided between said upper wall and said lower wall for dividing said chamber into a first section and a second section, a passageway interconnecting said first section of said chamber with said second section of said chamber, an inlet in communication with said first section of said chamber and an outlet in communication with said second section of said chamber, said cover being hingedly mounted on said hearth in a manner to be juxtaposed in heat-conducting overlapping relationship to said hearth plate in juxta relationship whereby air conducted through said cover is heated as it flows through said second section of said chamber of said cover and the upper side of said cover is cooled by air flowing though said first section of said chamber of said cover.

* * * * *